United States Patent [19]

Elsbett et al.

[11] Patent Number: 4,813,389

[45] Date of Patent: Mar. 21, 1989

[54] FUEL INJECTION SYSTEM FOR INTERNAL COMBUSTION ENGINES

[76] Inventors: Ludwig Elsbett; Günter Elsbett; Klaus Elsbett, all of Industriestrasse 14-16, D-8543 Hilpoltstein, Fed. Rep. of Germany

[21] Appl. No.: 110,287

[22] Filed: Oct. 19, 1987

[30] Foreign Application Priority Data

Oct. 20, 1986 [DE] Fed. Rep. of Germany ..... 3635557

[51] Int. Cl.[4] ..... F02M 39/00

[52] U.S. Cl. ..... 123/373; 123/382; 123/179 L

[58] Field of Search ..... 123/373, 383, 500, 501, 123/389, 382, 179 L

[56] References Cited

U.S. PATENT DOCUMENTS

| | | | |
|---|---|---|---|
| 2,117,248 | 5/1938 | Hurst | 123/373 |
| 2,123,433 | 7/1938 | Mayo | 123/373 |
| 2,868,184 | 1/1959 | Moulton | 123/383 |
| 2,965,089 | 12/1960 | Holley | 123/179 L |
| 3,727,598 | 4/1923 | Knapp | 123/179 L |
| 4,015,573 | 4/1977 | Okura | 123/383 |
| 4,204,510 | 5/1980 | Ritter | 123/179 L |
| 4,227,504 | 10/1980 | Ritter | 123/383 |
| 4,387,688 | 6/1983 | Eheim | 123/179 L |
| 4,625,900 | 12/1986 | Elsbett | 123/500 |

*Primary Examiner*—Carl Stuart Miller
*Attorney, Agent, or Firm*—Peter K. Kontler

[57] ABSTRACT

A fuel injection system for spontaneous-combustion engines wherein a first reciprocable element regulates the quantity of injected fuel and a second reciprocable element regulates the timing of fuel injection. The elements are movable by discrete centrifugal governors on a shaft which is driven by the camshaft as a function of the RPM of the engine. The elements are further movable by additional moving devices in dependency on changes of other engine parameters. Such additional devices can include a turbo charger, a vacuum governor, a gas pedal and an arresting lever. The elements adjust the fuel injector pump or pumps of the engine.

17 Claims, 2 Drawing Sheets

1a
35
15
31
31a
18
19
21
ALA
LDA
34
20
1
9
134
133a
133
16
17
12
102
15a
33
5b
5a
36
6
6
6a
6a
23
22
8
7
2
7
22a
32a
26
27
PAB
32
14
13
125
24
3
25
ASA
30
4
10
11
29a
128
29
28
28a
KSB

FUEL INJECTION SYSTEM FOR INTERNAL COMBUSTION ENGINES

BACKGROUND OF THE INVENTION

The present invention relates to internal combustion engines in general, and more particularly to improvements in internal combustion engines wherein the fuel (such as diesel oil or vegetable oil) is injected into the cylinder chamber or chambers, e.g., into cylinder chambers which are provided in the top faces of pistons. Still more particularly, the invention relates to improvements in apparatus for regulating the operation of fuel injection systems in internal combustion engines.

It is known to provide an apparatus which regulates the fuel injection system of an internal combustion engine with control elements serving to select the timing of fuel admission and the quantity of admitted fuel as a function of rotational speed of the engine. As a rule, the means for regulating the timing is a separate entity, the same as the means for regulating the quantity of injected fuel. The quantity of injected fuel is regulated by a centrifugal governor which is mounted on the camshaft for the injection pump. On the other hand, the timing of fuel injection is regulated by changing the angular position of the camshaft relative to the drive means. A drawback of such apparatus is that they are bulky which is undesirable in many types of internal combustion engines as well as in vehicles which embody such engines.

OBJECTS AND SUMMARY OF THE INVENTION

An object of the invention is to provide a novel and improved apparatus for regulating the operation of fuel injection systems in internal combustion engines and to construct and assemble the apparatus in such a way that its space requirements are a fraction of those of conventional regulating apparatus.

Another object of the invention is to provide an engine which embodies the above outlined apparatus.

A further object of the invention is to provide an apparatus which can be integrated into the cylinder head of an internal combustion engine.

An additional object of the invention is to provide an apparatus whose components are or can constitute simple mechanical parts and which is capable of regulating the rate of fuel admission as well as the timing of fuel admission in dependency on a large number of parameters such as the rotational speed of the engine, the temperature of the ambient atmosphere, the load upon the engine and others.

Still another object of the invention is to provide a cylinder head which embodies the above outlined apparatus.

A further object of the invention is to provide an apparatus wherein all parts are readily accessible and wherein the positions of numerous parts can be adjusted and such parts maintained in selected positions or within selected ranges of positions in a simple and time-saving manner.

Another object of the invention is to provide a novel fuel injection system for spontaneous-combustion engines.

The invention is embodied in a fuel injection system for an internal combustion engine. The injection system comprises a mobile first element (e.g., a first reciprocable rod or bar) which regulates the quantity of injected fuel, a mobile second element (e.g., a second reciprocable rod or bar) for timing the injection of fuel, first moving means for moving the first and second elements as a function of changes in rotational speed of the engine including centrifugal governor means and means (e.g., a pair of pivotable levers) for operatively connecting the governor means with the first and second elements, and additional moving means for moving the first and second elements in response to changes in parameters of the engine other than the rotational speed. The governor means can comprise discrete first and second centrifugal governors for the first and second elements. The first moving means can further comprise means for driving the governor means and means for transmitting torque to the driving means. The driving means can comprise a first shaft which mounts the governor means, and the torque transmitting means can include a camshaft which is parallel to the first shaft.

The injection system further comprises a support for the first and second elements and for the moving means, and such support can include a cylinder head.

One of the parameters is or can be the temperature of the engine. The additional moving means can include a linkage which is actuatable to move the first element and thermostat means for actuating the linkage. The additional moving means can include a gas pedal (this gas pedal can constitute one component of the just mentioned linkage) which is movable to a plurality of starting positions to select the idling speed of the engine, means for coupling the gas pedal to the first element (such coupling means can include a set of coil springs and one lever of the means for operatively connecting the governor means with the first and second elements), and the aforementioned thermostat means (or discrete second thermostat means) for selecting the starting position of the gas pedal.

The additional moving means can comprise a turbo charger which is arranged to supply air to the engine at a plurality of pressures, and means for changing the position of the first element as a function of changes of the pressure of air which is supplied by the turbo charger so as to select the maximum quantity of injected fuel in dependency upon the aforementioned changes of pressure. Turbo chargers are standard equipment in many types of trucks and in racing cars; they can be driven by the engine or by hot combustion products.

The injection system preferably further comprises a linkage for transmission of motion between the first and second elements (i.e., by a route other than through the means for operatively connecting the governor means with the first and second elements). The means for operatively connecting the governor means with the first and second elements can include a first lever which serves to receive motion from the governor means and to move one of the first and second elements (preferably the second element), and the linkage for transmission of motion between the first and second elements can include a second lever which is pivotable relative to the first lever and cam and follower means interposed between the first and second levers. The additional moving means can include a manually movable lever or arm which can pivot the second lever, the aforementioned turbo charger which can pivot the second lever and/or a vacuum governor which can pivot the second lever.

The linkage for transmission of motion between the first and second elements can further comprise a third lever which is interposed between the second lever and the other of the first and second elements. The third lever can be pivotably mounted on the first element and the linkage can further comprise a stop for the third lever and a strong coil spring or other suitable means for biasing the third lever to either of two positions with reference to the stop. The first element serves to select a first quantity of injected fuel to start the engine in one position of the third lever and a second quantity of injected fuel to start the engine in the other position of the third lever. The second lever is pivotable to pivot the third lever from one to the other of its positions, and the third lever is pivotable from the other to the one position by the first element in response to a predetermined RPM of the governor means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
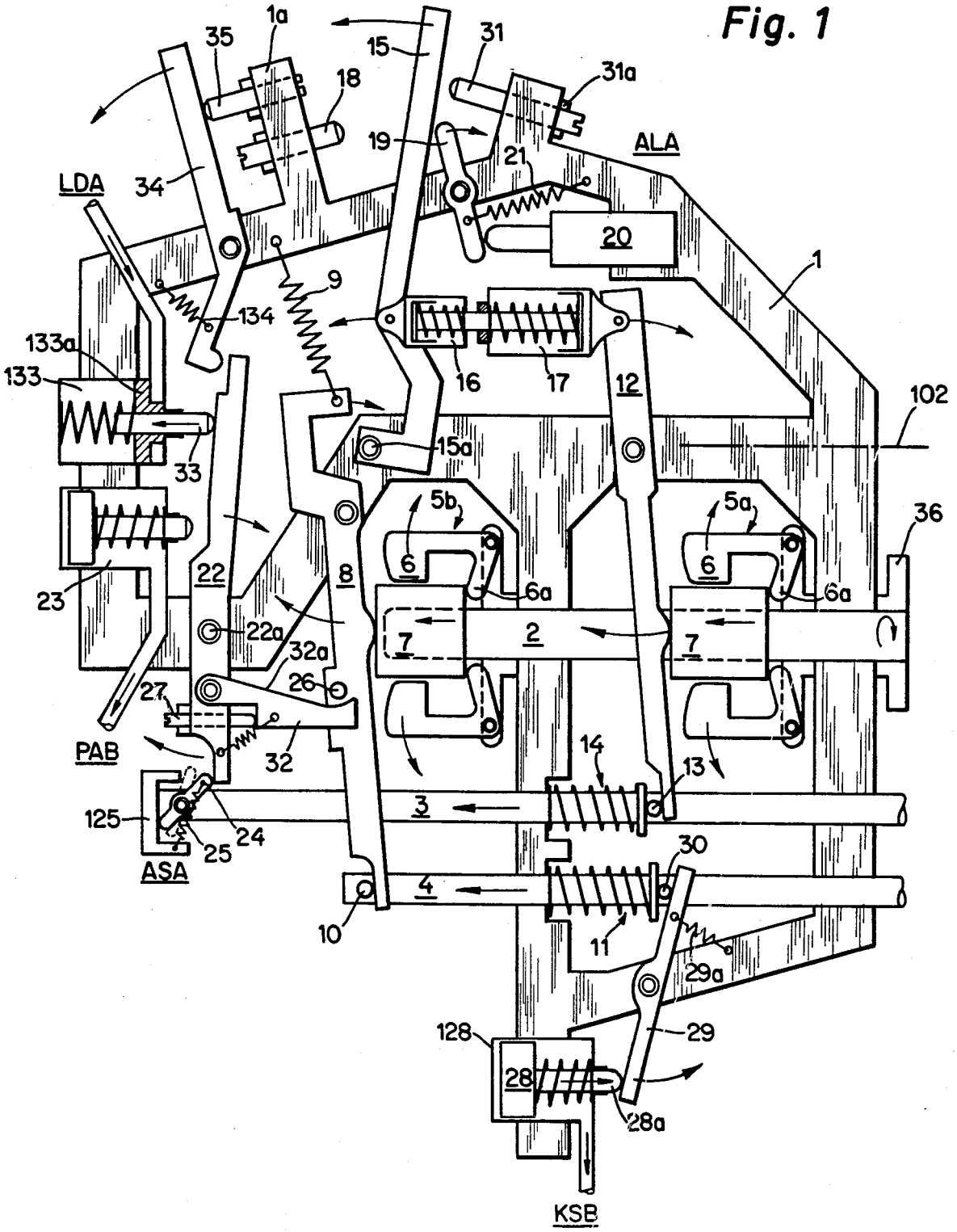
FIG. 1 is a partly elevational and partly sectional view of an apparatus which embodies one form of the present invention and wherein the elements which select the quantity of injected fuel and the timing of fuel injection are shown in end positions corresponding to zero rate of fuel injection and an advanced timing of fuel injection.

The fuel injection system which is shown in the drawing comprises a support 1 for a control shaft 2 which is parallel with two reciprocable regulating elements 3 and 4. The support 1 can form part of or can constitute the cylinder head of the engine. The element 3 serves to regulate the quantity of injected fuel, and the element 4 serves to regulate the timing of injection of fuel. The element 3 must be moved in a direction to the left in order to reduce the quantity of injected fuel, and the element 4 must be moved in a direction to the left in order to advance the timing of fuel injection. The manner in which the elements 3 and 4 actually influence the fuel injector or injectors forms no part of the present invention because it is well known from the art of internal combustion engines and, therefore, need not be described here. For example, the quantity of fuel delivered to the spray nozzle or nozzles is or can be regulated by the time the plunger of the fuel injection pump covers a bypass port, and the timing of the injection will occur as demanded by the requirements of the engine. Reference may be had, for example, to the DEPARTMENT OF THE ARMY TECHNICAL MANUAL TM9-8000 TO 36A-1-76 entitled "Principles of automotive vehicles".

The right-hand end portion of the shaft 2 carries a gear 36 forming part of a gear train which further includes an intermediate gear and is used to establish a torque-transmitting connection between the shaft 2 and the camshaft (indicated by a phantom line 102) of the internal combustion engine. The shafts 2 and 102 are parallel to each other. Reference may be had to the commonly owned copending patent application Ser. No. 110,288 filed Oct. 19, 1987 for "Cylinder head and hood therefor" which shows a camshaft in the cylinder head and a torque transmitting connection between the camshaft and a control shaft. The transmission which includes the gear 36 is designed in such a way that the RPM of the shaft 2 deviates from (it is normally higher than) the RPM of the camshaft 102.

The shaft 2 carries and drives two preferably identical centrifugal governors **5*a* and 5*b* which have pivotably mounted weights 6 arranged to act upon sleeves 7 which are movable axially of the shaft 2. The arrangement is such that, as the RPM of the shaft 2 increases, the centrifugal force acting upon the weights 6 causes these weights to pivot in directions to shift the respective sleeves 7 to the left and to thereby respectively pivot two two-armed levers 12 and 8 which are pivotably mounted in the support 1 and operatively connect the governors 5*a*, 5*b* with the elements 3 and 4, respectively. The lever 12 is biased in a counterclockwise direction by a coil spring 14 which reacts against the support 1 and bears upon a pin-shaped follower 13 of the element 3. This ensures that the longer arm of the lever 12 bears upon the respective sleeve 7 and maintains it in contact with the motion-transmitting arms 6*a* of the weights 6 in the centrifugal governor 5*a*. The sleeve 7 of the centrifugal governor 5*b* abuts the lower arm of the lever 8 which is biased by a coil spring 9 and by a coil spring 11 through the medium of pin-shaped followers 10 and 30 on the element 4 so that the lever 8 bears against the respective sleeve 7 and maintains the sleeve in contact with the arms 6*a* of the weights 6 of the governor 5*b*. The coil spring 11 reacts against the frame 1 and bears against the pin-shaped follower 30 on the element 4. The coil spring 11 urges the element 4 in a direction to delay the timing of fuel injection. Thus, an acceleration of the shaft 2** entails a reduction of the quantity of injected fuel and advances the timing of injection.

The upper arm of the lever 12 is acted upon (indirectly) by a gas pedal 15 which is a one-armed lever fulcrumed at **15*a* and adapted to be pivoted in a counterclockwise direction to thereby pivot the lever 12 in the same direction, namely so as to enable the coil spring 14 to bias the element 3 to the right (in order to increase the quantity of injected fuel). FIG. 1 shows the gas pedal 15 in one of several positions for idling of the engine. The indirect connection between the gas pedal 15 and the lever 12, which controls the element 3, is established by a package of coil springs including an idling spring 16 and a fuel quantity reducing spring 17. The idling spring 16 is dimensioned and mounted in such a way that it is effective only when the engine is driven at idling speed; it is fully compressed to act as a rigid block (its convolutions abut each other) when the gas pedal 15 is pivoted in a counterclockwise direction to accelerate the engine above the idling speed. The coil spring 17 is installed in prestressed condition and is caused to store additional energy only when the weights 6 of the centrifugal governor 5*a* are orbited at an RPM which suffices to overcome the initial stressing of the spring 17. The initial stressing of the spring 17 is preferably such that the spring undergoes additional deformation and stores additional energy only when the engine is driven at a maximum RPM, i.e., the spring 17 acts as a means for regulating the rate of fuel admission (in the range between the idling and maximum RPM of the engine) in response to changes in angular position of the gas pedal 15. The spring 17 is installed in unstressed condition if the apparatus of FIG. 1** is to serve exclusively as a means for regulating the RPM of the engine.

The maximum RPM of the engine is determined by the selected position of an adjustable stop 18 which is or can constitute an externally threaded bolt or screw mating with an outwardly projecting extension 1*a* of the support 1. The idling RPM of the engine is determined by an adjustable stop 19 in the form of a two-armed lever which is fulcrumed in the support 1 and is biased in a counterclockwise direction by a coil spring 21. A thermostat 20 is used to pivot the stop 19 in a clockwise direction against the opposition of the coil spring 21 and to change the right-hand end position of the gas pedal 15 in a direction to raise the idling RPM when the temperature of the surrounding air rises. The parts 19–21 constitute a mechanism or unit ALA which serves to automatically alter the idling RPM of the engine as a function of temperature of the ambient atmosphere. If the temperature rises to a value at which the thermostat 20 would be likely to reduce the idling RPM to an unacceptably low value, the gas pedal 15 engages a stop 31 which is adjustable in the same way as the stop 18 and then prevents any further deceleration of the engine. A lock nut 31*a* is provided to releasably fix the stop 31 in a selected axial position.

The apparatus further comprises an additional two-armed lever 22 which can be pivoted at 22*a* in a clockwise direction to indirectly pull the element 3 to the left and to thus effect an interruption of the admission of fuel to the injector nozzle(s) of the engine. The lever 22 is pivotable by a vacuum governor 23 and constitutes therewith a mechanism or unit PAB which can reduce the rate of fuel admission to zero. The unit is a suction pump which is used in conjunction with servo brakes in vehicles using diesel engines. The character ASA denotes a further mechanism or unit which is mounted in part on the element 3 and can be actuated by the lever 22 to automatically increase the rate of fuel admission during starting of the engine. The mechanism ASA includes a two-armed lever 24 which is pivotably mounted on the left-hand end portion of the element 3 and is biased clockwise by a strong coil spring 25 which tends to maintain it in the solid-line position in which the lower arm of the lever 24 bears against a fixed stop or abutment 125. The operation of the mechanism or unit ASA is as follows:

When the element 3 reaches its left-hand end position, i.e., when the spring 14 is fully compressed so that it acts as a solid block, the engine is arrested and, if the lever 22 is pivoted clockwise beyond the illustrated position, the lever 24 on the element 3 leaves the solid-line position and is pivoted against the opposition of the coil spring 25 toward and to the phantom-line position in which its upper arm engages the upper leg of the substantially C-shaped abutment 125. This ensures that, when the engine is started again, the element 3 can cover a certain distance before the upper arm of the lever 25 strikes against the lower end portion of the lever 22 and causes a pivotable cam 32 on the lever 22 to engage a follower 26 (e.g., a pin) on the lower arm of the lever 8. When the lever 24 assumes the phantom-line position of FIG. 1, the force of the coil spring 25 acting upon this lever is smaller than the force of the coil spring 14. Therefore, the lever 24 is free to reassume the solid-line position of FIG. 1 only when the RPM of the control shaft 2 is sufficiently high to compel the centrifugal governor 5*a* to move the element 3 to the left through the medium of the lever 12 and follower 13 so that the element 3 reassumes its zero position. At such time, the upper arm of the lever 24 moves away from the lower end portion of the lever 22 and enables the coil spring 25 to return the lower arm of the lever 24 into engagement with the abutment 125. The force with which the coil spring 25 then biases the lever 24 (to the solid-line position of FIG. 1) is greater than the force of the coil spring 14. Such starting or neutral position of the mechanism or unit ASA is shown by solid lines. This ensures that the angular position of the lever 24 does not change while the engine is running, i.e., that the quantity of fuel which is to be admitted to restart the engine remains unchanged unless the lever 24 is again pivoted to the phantom-line position in response to pivoting of the lever 22.

The lever 22 further serves as a means for regulating the maximum rate of fuel admission as a function of the RPM of the engine. To this end, the lever 8 carries the aforementioned pin-shaped follower 26 which travels along a sloping face 32*a* of the cam 32 to thereby change the (full-load) position of the lever 22 accordingly. An adjusting screw 27 serves as a means for altering the inclination of the face 32*a* with reference to the lever 22.

The character LDA denotes a turbo charger which can alter the boost pressure by changing the angular position of the lever 22 through the medium of a pin 33 mounted in the piston or plunger 133*a* in a cylinder 133. When the pressure of air which is compressed by the turbo charger LDA is low, a lesser quantity of fuel is injected during the acceleration stage than would normally be the case under the influence of the cam face 32*a*. When the pressure reaches its maximum value, the plunger 133*a* in the cylinder 133 is shifted in the direction of arrow and retracts the pin 33 so that the lever 22 can turn counterclockwise and enables the face 32*a* to control the quantity of injected fuel during operation at a maximum load.

When the temperature of the ambient atmosphere is low, a mechanism or unit KSB becomes operative to advance the starting of the cold engine by advancing the timing of fuel injection, even at the lower RPM of the engine. To this end, a cylinder 128 contains a piston or plunger 28 with a pin-shaped pusher 28*a* which can pivot a two-armed lever 29 against the opposition of a coil spring 29*a* so that the upper arm of the lever 29 shifts the element 4 through the medium of the follower 30 against the opposition of the coil spring 11 to thus advance the timing of fuel injection. The mechanism KSB can be driven magnetically, electrically or mechanically.

The engine can be arrested by way of a manually pivotable lever 34 which is biased by a coil spring 134 to normally bear against an adjustable stop 35. The stop 35 further serves as a means for limiting the quantity of injected fuel at maximum load when the cam 32 and its face 32*a* are not needed, e.g., in a generator.

The centrifugal governors 5*a*, 5*b* serve to move the elements 3 and 4 through the medium of the operative connection (levers) 12 and 8 in response to changes of rotational speed of the engine and its camshaft 102. The parts, mechanisms and units 15, 20, KSB, ASA, PAB, LDA and 34 serve as additional moving means to move the element and/or 4 in response to changes in engine parameters other than the rotational speed. One of these parameters is the temperature of the engine. The linkage including the lever 19, the gas pedal 15 and the coil springs 16, 17 is actuatable by the thermostat 20 to move the element 3 through the medium of the lever 12 in response to changes in temperature. Thus, the gas pedal 15 constitutes one component of the additional moving means and is movable by the lever 19 and thermostat 20 to a number of different starting positions to thereby select the idling speed of the engine. The parts 12, 16 and 17 can be said to constitute a means for coupling the gas pedal 15 to the first element 13, and the thermostat 20 serves to select the starting position of the engine.

The turbo charger LDA also constitutes a part of the additional moving means and its function is to change the position of the element 3 through the medium of a motion transmitting linkage (including the lever 22, the lever 24, the cam 32 and the follower 26) which is interposed between the elements 3 and 4. The parts 132, 133*a*, 33, 22 and 24 serve to change the position of the element 3 as a function of changes of the pressure of air which is supplied to the engine by the turbo charger LDA. Thus, the turbo charger can select the maximum quantity of injected fuel on dependency on changes of pressure of air which is supplied to the engine by the turbo charger.

The lever 24 constitutes the third lever of the linkage between the elements 3 and 4; the lever 22 is the second lever and the lever 8 is the first lever of such linkage. The lever 22 can pivot the lever 24 from one to the other position, and the element 3 can pivot the lever 24 from the other to the one position. As explained above, the lever 22 can be pivoted by the manually operable lever 34, by the turbo charger LDA and/or by the vacuum governor PAB.

Figure 2:
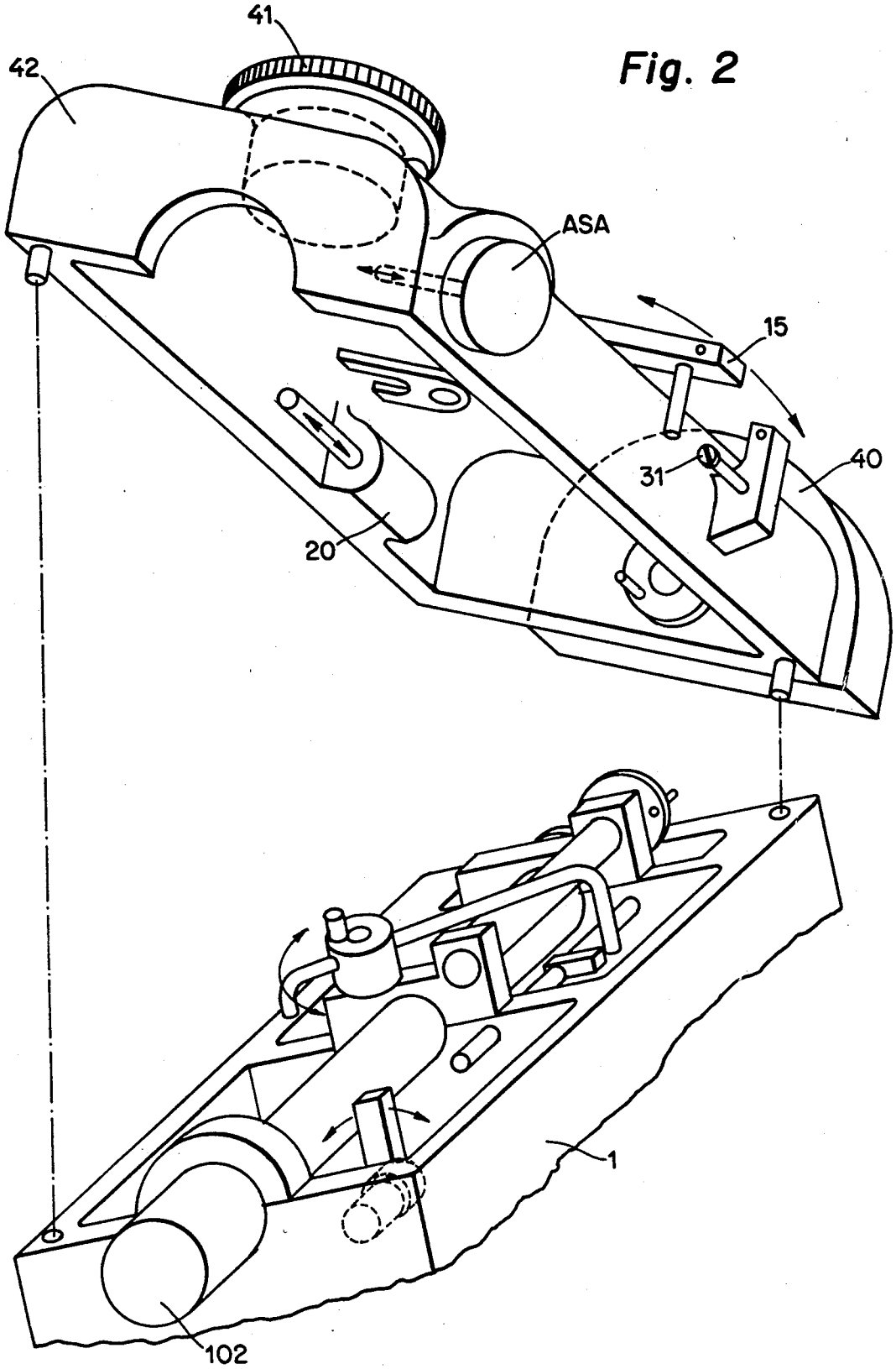
FIG. 2 is a perspective view of a cylinder head and a hood for the cylinder head, showing certain parts which can influence the timing of fuel injection and the quantity of injected fuel, and further showing the camshaft which drives the shaft for the centrifugal governors.

FIG. 2 shows the camshaft 102 in the head 1 of the cylinder or cylinders of the engine. This figure further shows a gas pedal 15, a vacuum governor ASA, a fuel pump 40, a stopper 41 for the opening which admits oil into the sump of the engine, a hood 42 which carries the stopper 41, a thermostat 20, the stop 31 for the pedal 15, and certain other components which form part of a modified engine but can be transferred into the injection system of FIG. 1 to impart to the element 3 and/or 4 additional movements in dependency on various parameters of the engine. FIG. 2 is identical with FIG. 1 in the aforementioned commonly owned copending patent application Ser. No. 110,288 for "Cylinder head and hood therefor".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a fuel system for an internal combustion engine, the combination of a mobile first element for regulating the quantity of injected fuel; a mobile second element for timing the injection of fuel; first moving means for moving said elements as a function of changes in rotational speed of the engine, including discrete independent coaxial first and second centrifugal governors for said first and second elements, respectively, common means for driving said first and second governors, and means for mechanically connecting said first and second governors with said first and second elements, respectively; and additional moving means for moving said elements in response to changes in parameters of the engine other than said rotational speed.

2. In a fuel injection system for an internal combustion engine, the combination of a mobile first element for regulating the quantity of injected fuel; a mobile second element for timing the injection of fuel; first moving means for moving said elements as a function of changes in rotational speed of the engine, including centrifugal governor means and means for operatively connecting said governor means with said elements, said connecting means including a first lever arranged to receive motion from said governor means and to move one of said elements; additional moving means for moving said elements in response to changes in parameters of the engine other than said rotational speed; and a linkage for transmission of motion between said elements, said linkage including a second layer pivotable relative to said first lever and cam and follower means interposed between said levers, and a third lever interposed between said second lever and the other of said elements.

3. The combination of claim 1, wherein said first moving means further comprises means for transmitting torque to said driving means, said driving means comprising a first shaft mounting said governors and said torque transmitting means including a camshaft parallel to said first shaft.

4. The combination of claim 1, further comprising a support for said elements and said moving means, said support including a cylinder head.

5. The combination of claim 1, wherein one of said parameters is the temperature of the engine.

6. The combination of claim 5, wherein said additional moving means includes a linkage actuatable to move said first element and thermostat means for actuating said linkage.

7. The combination of claim 5, wherein said additional moving means includes a gas pedal movable to a plurality of starting positions to select the idling speed of the engine, means for coupling said pedal to said first element, and thermostat means for selecting the starting position of said pedal.

8. The combination of claim 1, wherein said additional moving means comprises a turbo charger arranged to supply air to the engine at a plurality of pressures, and means for changing the position of said first element as a function of changes of the pressure of air which is supplied by said turbo charger so as to select the maximum quantity of injected fuel in dependency on said changes of pressure.

9. The combination of claim 1, further comprising a linkage for transmission of motion between said elements.

10. The combination of claim 9, wherein said means for mechanically connecting said governors with said elements includes a first lever arranged to receive motion from one of said governors and to move one of said elements, said linkage including a second lever pivotable relative to said first lever and cam and follower means interposed between said levers.

11. The combination of claim 10, wherein said additional moving means includes a manually operable lever arranged to pivot said second lever.

12. The combination of claim 10, wherein said additional moving means includes a turbo charger arranged to pivot said second lever.

13. The combination of claim 10, wherein said additional moving means comprises a vacuum governor arranged to pivot said second lever.

14. The combination of claim 2, wherein said third lever is pivotably mounted on said first element and further comprising a stop for said third lever and means for biasing said third lever to either of two positions with reference to said stop, said first element being arranged to select a first quantity of injected fuel for starting of the engine in one position of said third lever and a second quantity of injected fuel for starting of the engine in the other position of said third lever.

15. The combination of claim 14, wherein said second lever is pivotable to pivot said third lever from one of said positions to the other of said positions.

16. The combination of claim 14, wherein said third lever is pivotable from one to the other of said positions by said first element in response to a predetermined RPM of said governor means.

17. The combination of claim 1, further comprising hollow cylinder head, said elements and said moving means being disposed in said cylinder head.

* * * * *